US005957791A

United States Patent [19]

Nichols et al.

[11] Patent Number: 5,957,791

[45] Date of Patent: Sep. 28, 1999

[54] LACROSSE STICK HEAD WITH UPPER STRING HOLES AND METHOD FOR STRINGING SAME

[75] Inventors: Timothy S. Nichols, Jamaica, Vt.; Brian D. Johnson, Holliston, Mass.

[73] Assignee: Sports Licensing, inc., Hanover, N.H.

[21] Appl. No.: 09/018,724

[22] Filed: Feb. 4, 1998

[51] Int. Cl.[6] ..... A63B 59/02

[52] U.S. Cl. ..... 473/513

[58] Field of Search ..... 473/513, FOR 204

[56] References Cited

U.S. PATENT DOCUMENTS 2,142,527 1/1939 Pool ..... 473/513

*Primary Examiner*—William H. Grieb
*Attorney, Agent, or Firm*—Brian M. Dingman

[57] ABSTRACT

A lacrosse stick head generally comprising a frame and netting wherein the frame comprises sidewalls having an upper edge and a lower edge, wherein the upper edge of the sidewalls are provided with a plurality of netting holes through which the netting is attached to the frame and a method for stringing the lacrosse stick head.

11 Claims, 13 Drawing Sheets

LACROSSE STICK HEAD WITH UPPER STRING HOLES AND METHOD FOR STRINGING SAME

FIELD OF THE INVENTION

This invention relates to lacrosse sticks which have improved handling and playing characteristics, and more specifically to lacrosse stick heads, and method for stringing these heads, having a frame and netting wherein the netting is strung through holes provided proximate the upper edge of the sidewalls, creating a deeper and more narrow pocket for better catching, channeling and throwing.

BACKGROUND OF THE INVENTION

Lacrosse sticks having a net and a frame with sidewalls generally configured to catch, carry and throw a lacrosse ball are well known in the art. The netting is typically attached to the lacrosse head frame by threading the netting through netting holes provided proximate to the bottom edge of the sidewalls. The lacrosse heads of the prior art have included netting holes provided through tabs extending from the bottom edge of the sidewalls, netting holes bored transversely through the sidewall, and netting holes bored through a flange provided proximate the bottom edge. Yet, in each of these lacrosse heads, the netting is intended to hang downward from the lower edge of the sidewalls with as little contact with the lacrosse head frame as possible.

Generally deeper and more narrow pockets in the netting are desired to help catch and retain the lacrosse ball in the lacrosse head during play and to help channel the lacrosse ball as it is thrown for better accuracy and speed. However, the current rules for men's lacrosse require that a portion of the lacrosse ball always be above the bottom edge of the sidewalls of the lacrosse stick head. In contrast, the current rules for women's lacrosse require that a portion of the ball always be above the top edge of the sidewalls of the lacrosse stick head. As a result, the depth of the men's lacrosse stick head pocket heretofore has been limited to a dimension slightly less than the diameter of the lacrosse ball and the depth of the pocket and sidewall of the women's lacrosse stick head has been limited to the diameter of the lacrosse ball. Additionally, because the netting of the prior art is attached proximate to, and hangs downward from, the bottom edge of the lacrosse head, the width of the upper edge of the pocket has been delimited by the space between the bottom opposing edges of the sidewalls. Although this substantial space is desired between the sidewalls to create a larger area in which to catch the lacrosse ball, this space is counterproductive to catching and retaining the ball in the lacrosse head during play and to throwing the lacrosse ball with the desired amount of accuracy. Rather, the wide aperture design of the lacrosse head frame, and therefore the net, allows the ball to move around laterally in the lacrosse head which makes throwing the lacrosse ball less accurate. First, this wide space reduces accuracy by allowing the ball to exit the lacrosse off-center when thrown. Second, this space enables an opponent to easily dislodge the ball from a player's stick during men's lacrosse play despite cradling techniques. Third, the tension across the netting required to meet the women's pocket depth rules makes catching the lacrosse ball a difficult task for all but the most experienced players.

Although vertical leathers or thongs are strung from the lip portion of the lacrosse frame to the throat portion to help create a channel in the pocket of the netting, these leathers do not adequately inhibit lateral movement of the ball when thrown, do not inhibit the ball from being dislodged during men's lacrosse play by an opponent and contribute to the rigidity of the netting in a women's lacrosse stick head when attempting to catch the ball.

SUMMARY OF THE INVENTION

It is therefore a primary object of this invention to provide a men's or women's lacrosse stick with improved handling, catching and/or throwing capabilities.

It is a further object of this invention to provide a men's or women's lacrosse stick head having a net comprising a series of graduated twists which provide more give or spring to the pocket of the net.

It is a further object of this invention to provide a men's or women's lacrosse stick head which has a deeper pocket.

It is a further object of this invention to provide a men's or women's lacrosse stick which has a more narrow pocket.

It is a further object of this invention to provide a men's lacrosse stick head having a frame and netting so configured as to more readily retain a lacrosse ball within the lacrosse head while running with the ball while maintaining the ball at a height within the lacrosse stick head so that the top of the lacrosse ball clears the lower edge of the sidewalls of the lacrosse stick head.

It is a further object of this invention to provide a men's lacrosse stick head having a frame and netting so configured to enable a player to throw a lacrosse ball with greater accuracy while maintaining the ball at a height within the lacrosse stick head so that the top of the lacrosse ball clears the lower edge of the sidewalls of the men's lacrosse stick head.

It is a further object of this invention to provide a men's lacrosse stick head having a frame and netting so configured to enable a player to catch a lacrosse ball with greater ease while maintaining the ball at a height within the lacrosse stick head so that the top of the lacrosse ball clears the lower edge of the sidewalls of the men's lacrosse stick head.

It is a further object of this invention to provide a women's lacrosse stick head having a frame and netting so configured to enable a player to throw a lacrosse ball with greater accuracy while maintaining the ball at a height within the lacrosse stick head so that the top of the lacrosse ball clears the upper edge of the sidewalls of the women's lacrosse stick head.

It is a further object of this invention to provide a women's lacrosse stick head having a frame and netting so configured to enable a player to catch a lacrosse ball with greater ease while maintaining the ball at a height within the lacrosse stick head so that the top of the lacrosse ball clears the upper edge of the sidewalls of the women's lacrosse stick head.

A preferred embodiment of the invention includes a lacrosse stick head comprising, a net and a frame wherein said frame comprises, a throat portion; two sidewalls, diverging from said throat portion, each sidewall having a bottom edge and a top edge, and a plurality of bottom points and a plurality of corresponding top points, wherein any one of said bottom points is chosen along said bottom edge and at which there is a tangent line, wherein a said corresponding top point is the point at which a line perpendicular to said tangent of a said chosen bottom point intersects said top edge, wherein said sidewalls have a plurality of upper areas corresponding to one or more particular corresponding top points which correspond to one or more particular chosen bottom points, and wherein a said upper area is closer to its said corresponding top points than to its said chosen bottom points; a means for securing the net to one or more of the upper areas so that at least a portion of the net, when secured, hangs between the sidewalls; and a lip portion joining the sidewalls opposite the throat portion.

The means for securing the net may comprise a plurality of holes provided through the sidewalls proximate the upper edge of the sidewalls. The preferred embodiment may also have sidewalls which further comprise a flange, and wherein the means for securing the net comprises a plurality of holes proximate the flange. The net preferably comprises a series of graduated twists which extend downward from the top edge of the sidewalls.

Another preferred embodiment of the invention includes a men's lacrosse stick head comprising a frame and net, wherein the frame comprises, a throat portion; two sidewalls diverging from the throat portion and having a lower edge; and a lip portion; wherein said net comprises, a pocket, wherein the pocket comprises an upper section having an inner area provided between the sidewalls within the frame and a lower section having an inner area that clears the lower edges of the sidewalls below the frame, wherein the area of said upper section provided between the sidewalls is larger than the area of the lower section that clears the lower edges; and a shooting section.

The sidewalls may further comprise a bottom edge and a top edge, and a plurality of bottom points and a plurality of corresponding top points, wherein any one of said bottom points is chosen along said bottom edge and at which there is a tangent line, wherein a said corresponding top point is the point at which a line perpendicular to said tangent of a said chosen bottom point intersects said top edge, wherein said sidewalls have a plurality of upper areas corresponding to one or more particular corresponding top points which correspond to one or more particular chosen bottom points, and wherein a said upper area is closer to its said corresponding top points than to its said chosen bottom points; and wherein the frame further comprises a means for securing the net to one or more of the upper areas. The means for securing the net may comprise a plurality of holes provided through the sidewalls -proximate the upper edge of the sidewalls. In addition or alternatively, the sidewalls may comprise a flange, wherein the means for securing the net may comprise a plurality of holes proximate the flange. Similarly the net preferably comprises a series of graduated twists which extend downward from the top edge of the sidewalls.

The lacrosse head of the invention provides a deeper and more narrow pocket in the head because the top of the net, instead of being strung from the bottom edge of the lacrosse head frame, is strung from the top portion of the lacrosse head frame. The net and frame are configured so that the net hangs between the sidewalls, enabling the pocket of the net to potentially be almost twice as deep as, and more narrow than, the prior art. A deeper and more narrow pocket cradles the ball more securely which helps a player to more readily catch and retain the ball in the lacrosse head during play. Further, accuracy of throwing is improved because the narrow pocket further channels and centers the ball as it exits the lacrosse head.

The lacrosse stick head of this invention envisions sidewalls, lip portions and throat portions that are solid except for the leather thong and netting holes, that have one or more auxiliary holes anywhere in the frame, and/or have flanges on the inner or outer sides of the sidewalls. The netting holes, which comprise both the sidewall string holes and the shooting string holes, may be spaced as desired in the upper portion of the sidewalls, and may be of any number capable of fulfilling the purpose of the invention.

The preferred method of this invention for stringing lacrosse heads having a throat portion with two sidewalls diverging therefrom, a lip portion joining the sidewalls opposite the throat portion and a plurality of string holes provided along both sidewalls, comprises the steps of: threading a plurality of thongs between the throat portion and the lip portion; lacing one or more sidewall laces through a plurality of the strings holes; attaching a pocket netting to lacrosse head, comprising the step of looping at least a portion of the pocket netting between one of the thongs and one of the sidewall laces so that a plurality of twists are formed in the pocket netting proximate each juncture of said pocket netting and the sidewall lace, wherein the twists extend downward from the junctures. The twists preferably comprise a series of twists of graduating lengths.

With respect to the upper strung women's lacrosse stick head of this invention, the invention greatly facilitates catching the lacrosse ball which enhances the learning process for beginning players. Further, this invention increases the accuracy of passing and shots on goal. Since women's lacrosse is not played with protective equipment by the field players, this invention is intended to increase the safety of women's lacrosse by reducing the chance of errant passes or shots striking other players.

The invention, when applied to a men's lacrosse stick, is intended to increase passing and shooting velocity and to reduce the chance of dislodging the ball by a defensive player's stick check. In contrast, the invention, when applied to a women's lacrosse stick, will not increase the velocity of a thrown ball or reduce the chance of dislodging the ball by a defensive player. Instead, the invention, when applied to a women's lacrosse stick, is designed to foster the safety of the women's lacrosse by continuing to maintain the ball in a women's lacrosse head so that the top of the ball clears the upper edge of the sidewalls.

BRIEF DESCRIPTION OF THE DRAWINGS

Other objects, features and advantages will occur to those skilled in the art from the following description of a preferred embodiment and the accompanying drawings in which.

DETAILED DESCRIPTION OF THE PREFERRED EMBODIMENTS

The lacrosse stick head of this invention is intended to provide a deeper and more narrow pocket to help catch a lacrosse ball with greater ease and to throw a lacrosse ball with greater accuracy. When applied to a men's lacrosse head, the invention also increases the velocity of the ball as the ball is thrown and helps to retain the ball in the net during play. The invention generally comprises a lacrosse stick head frame provided with holes proximate the upper edges of the sidewalls of the frame through which the sidewall and shooting strings of the netting materials are threaded so that the net, when attached, hangs between the sidewalls. This configuration of frame and netting creates a more narrow pocket and allows the netting to be adjusted to create a deeper pocket in the netting while still maintaining a portion of the lacrosse ball either above the bottom edge of the sidewalls in a men's lacrosse stick head or above the upper edge of the sidewalls in a women's lacrosse stick head.

Figure 1:
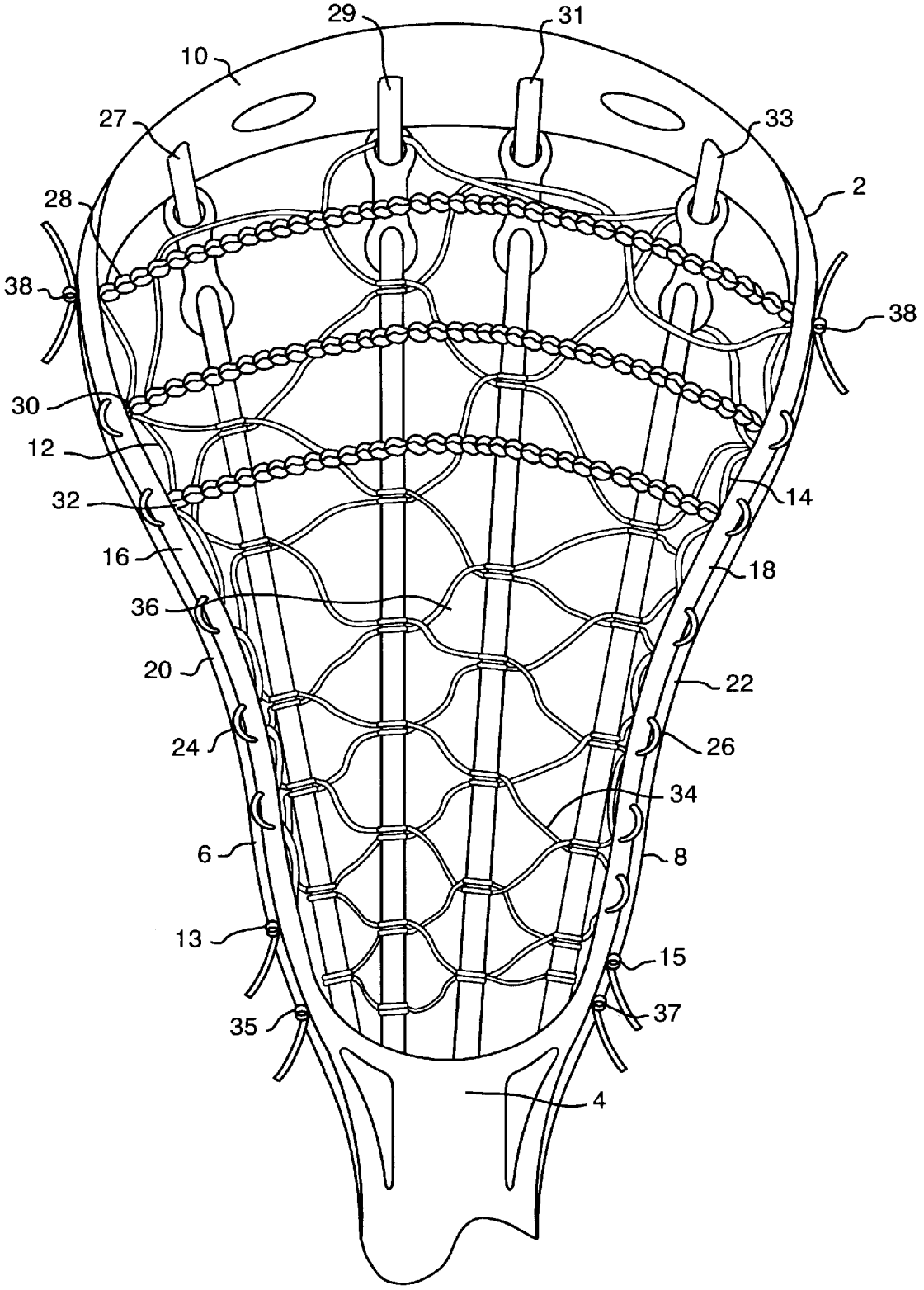
FIG. 1 is a top view of a preferred embodiment of the invention.
Figure 1A:
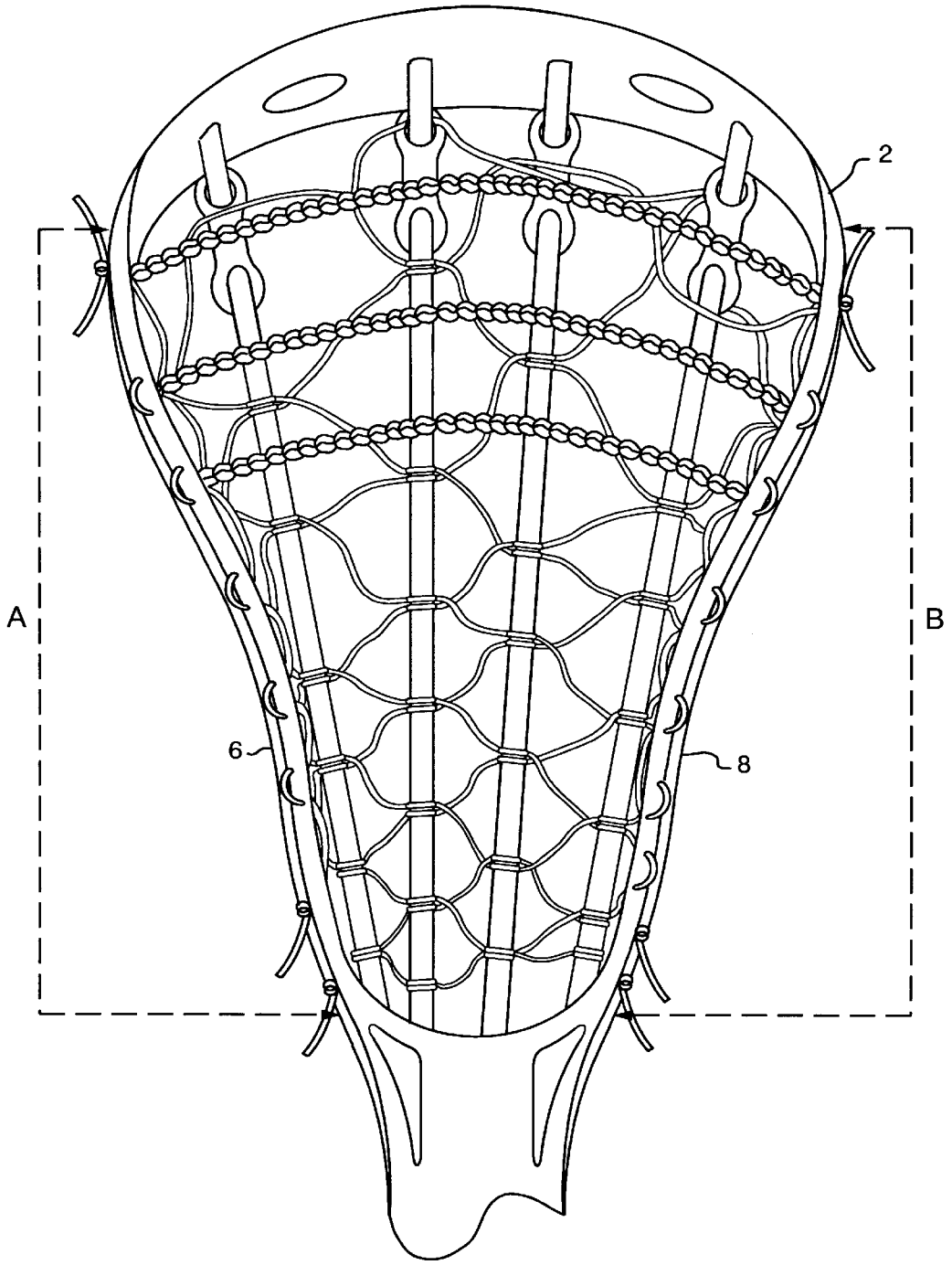
FIG. 1A is another top view of the preferred embodiment of FIG. 1.

FIG. 1 illustrates a preferred embodiment of the invention generally referred to as lacrosse head 2. The frame of lacrosse head 2 is made up of a throat portion 4, sidewalls 6 and 8 which diverge from throat portion 4, and lip portion 10 which joins sidewalls 6 and 8 opposite from throat portion 4. For purposes of this invention, sidewalls 6 and 8 are that portion of lacrosse head 2 as defined by arrows A and B, respectively, as shown in FIG. 1A. Sidewalls 6 and 8 have upper edges 16 and 18, respectively, and flanges 20 and 22, respectively.

Figure 2:
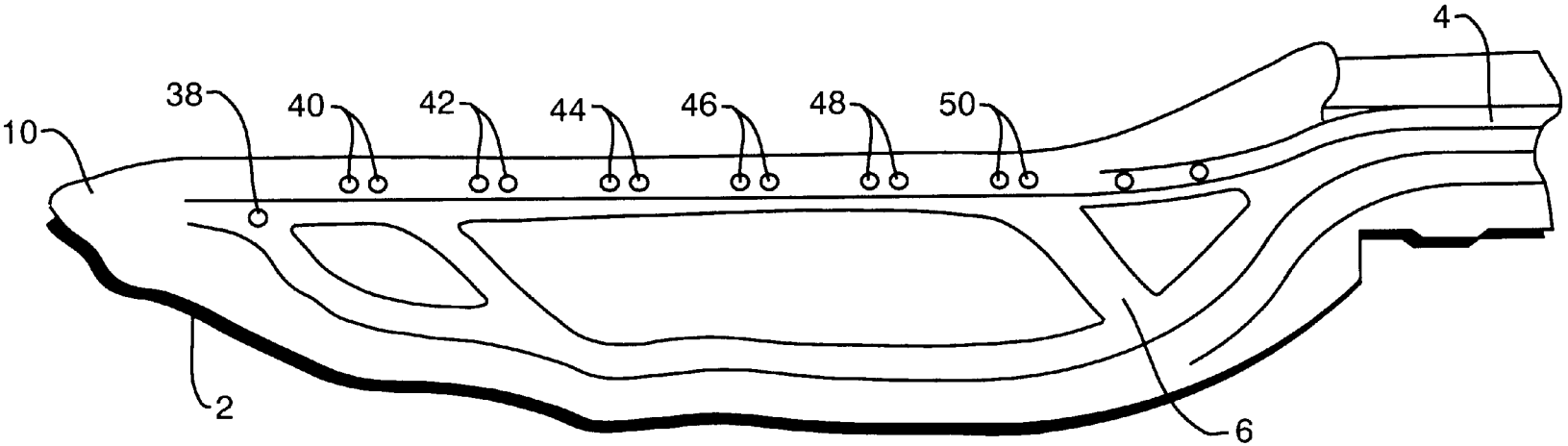
FIG. 2 is a side view of the left side of the frame of the preferred embodiment of FIG. 1.

FIG. 2 is a lateral view of the left side of lacrosse head 2 without a net therein. FIG. 2 shows string hole pairs 40, 42, 44, 46, 48 and 50 and string hole 38 in sidewall 6. Any of the string holes may be bored or molded directly through sidewall 6 and/or partially through outer flanges 20 and/or 22 or through an inner flange not shown. As shown in FIG. 1, leather thongs 27, 29, 31 and 33 are strung from holes in lip portion 10 to holes in throat portion 4. Sidewall laces 12 and 14 are initially tied off at holes 38 and threaded from the inner side of the sidewalls through string hole pairs 40 through 50 and finally tied off at holes 13 and 15, respectively. For example, sidewall lace portions 24 and 26 are shown in FIG. 1 as threaded through the second string hole pair from throat portion 4, which is shown as string hole pair 48 in FIG. 2. Shooting strings 28, 30 and 32 are threaded around and in between leather thongs 27 through 33 and tied off either along the sidewalls or along the sidewall laces.

Pocket lace 34 can be strung in a single piece or separately, for example as three pieces as described as follows. Pocket lace 34 can also adjusted to the depth desired. Start the first piece of pocket lacing by tying a first knot through hole 38 and loop down between leather thong 33 and sidewall lace 14. Tie off the first piece at hole 15. Repeat this procedure on the opposite side with a second piece of pocket lacing and tie off the second piece at hole 13. Start the third piece of pocket lacing by tying a knot through the hole in the top of thong 33 just below lip portion 10 and work up and down between all four thongs as shown in FIG. 1. Tie off the third piece in a hitch knot at a slit cut in thong 29 just above throat portion 4 or at hole 37. Set the depth of pocket 36 as desired and retie thongs 27, 29, 31 and 33 at throat portion 4. Keep in mind that this invention is specifically designed to allow for pocket 36 to be deeper than previous lacrosse stick heads.

Figure 3:
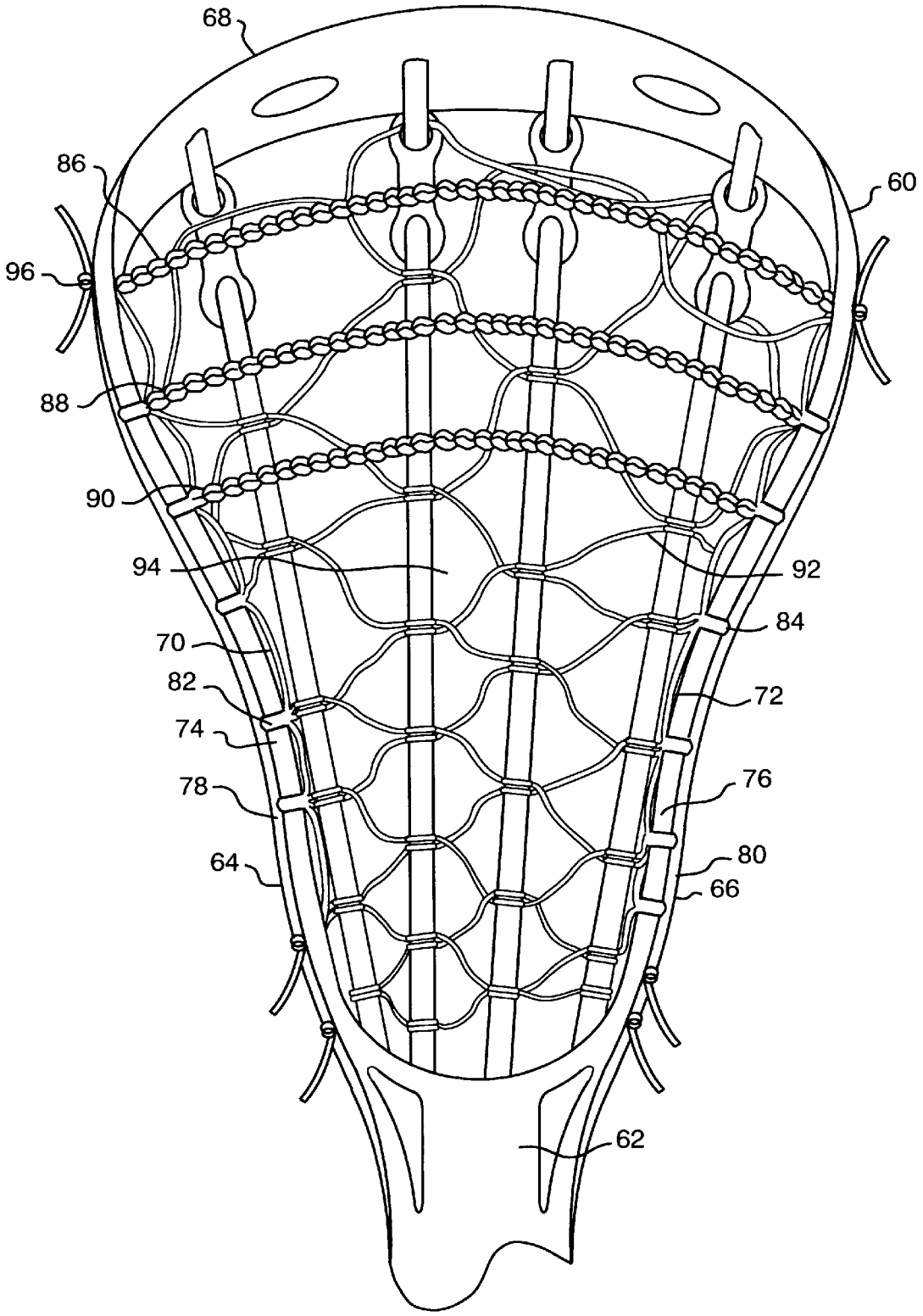
FIG. 3 is a top view of another preferred embodiment of the invention.

FIG. 3 illustrates another preferred embodiment of the invention. FIG. 3 shows a lacrosse stick head generally referred to as lacrosse head 60. The frame of lacrosse head 60 comprises throat portion 62, sidewalls 64 and 66 diverging from throat portion 62 and lip portion 68 joining sidewalls 64 and 66 opposite from throat portion 4. Sidewalls 64 and 66 have upper edges 74 and 76, respectively, and flanges 78 and 80, respectively.

Figure 5:
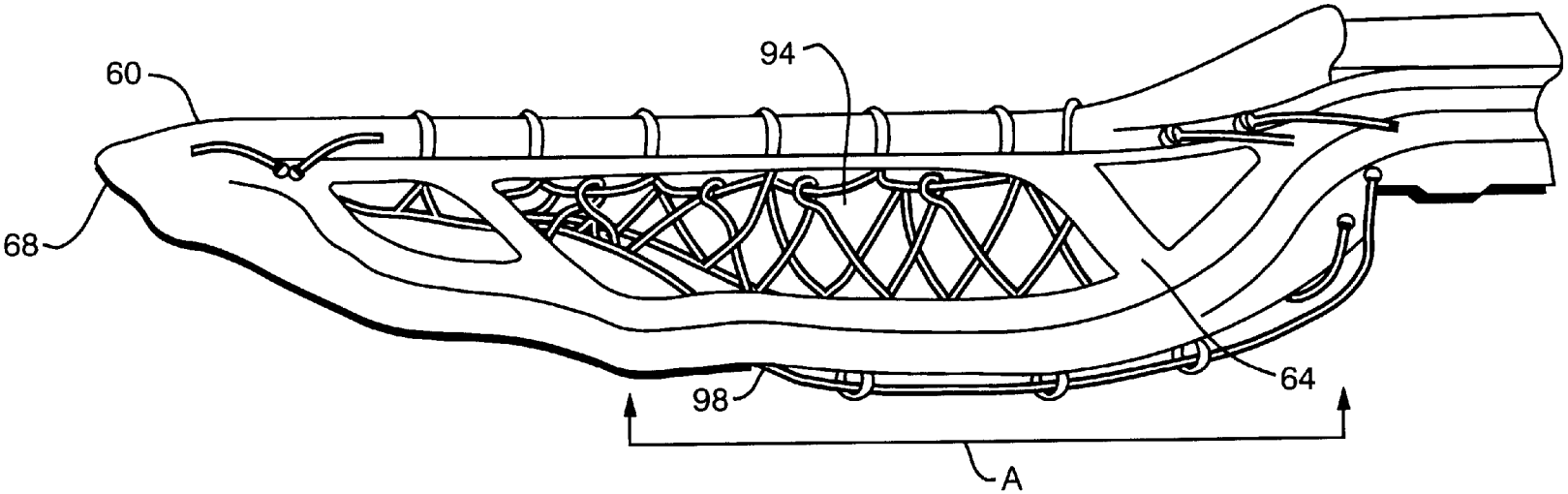
FIG. 5. is a side view of the left side of the preferred embodiment of FIG. 3.

The net of lacrosse head 60 is made up of a shooting section and pocket 94. Pocket 94 comprises the section of net closer to throat portion 62. The shooting section is closer to lip portion 68. Shooting strings 86, 88 and 90 approximate the boundaries of the shooting section and pocket 94 is approximately that area of the net below shooting string 90 and above throat portion 62. The lacrosse head of this invention is not limited to three shooting strings, but may comprise more or less as needed. There is a gradual descent in the net from the shooting portion, which begins proximate lip portion 68, to the lowest area of pocket 94 as shown in FIG. 5. FIG. 5 is a lateral view of the left side of lacrosse head 68. The boundaries of pocket 94 from the side are approximated by arrow A.

Figure 4:
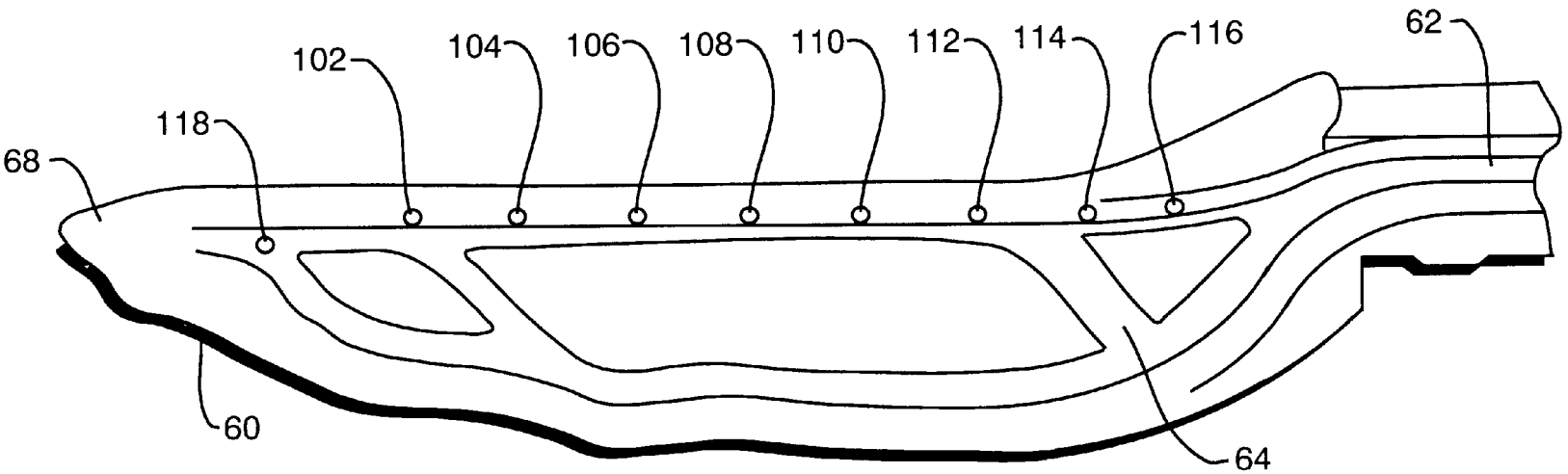
FIG. 4 is a side view of the left side of the frame of the preferred embodiment of FIG. 3.

FIG. 4 is a lateral view of the left side of lacrosse head 60 without a net therein. FIG. 4 shows string holes 102, 104, 106, 108, 110, and 112 and tie holes 114, 116 and 118 in sidewall 6. The string and tie holes may be bored or molded. Similar to the first preferred embodiment illustrated in FIG. 4, the leather thongs are strung from holes in lip portion 68 to holes in throat portion 62. Sidewall lace 70 is initially tied off at holes 96 and threaded from the inner side of sidewall 64 through string holes 102 through 112 and lastly tied off at hole 114. Sidewall lace 72 is similarly attached to sidewall 66. For example, sidewall lace portions 24 and 26 are shown in FIG. 3 as threaded through the second string hole from throat portion 62, which is shown as string hole 110 in FIG. 4. Shooting strings 86, 88 and 90 are threaded around and in between the leather thongs and tied off either along the sidewalls or along the sidewall laces.

Figure 6:
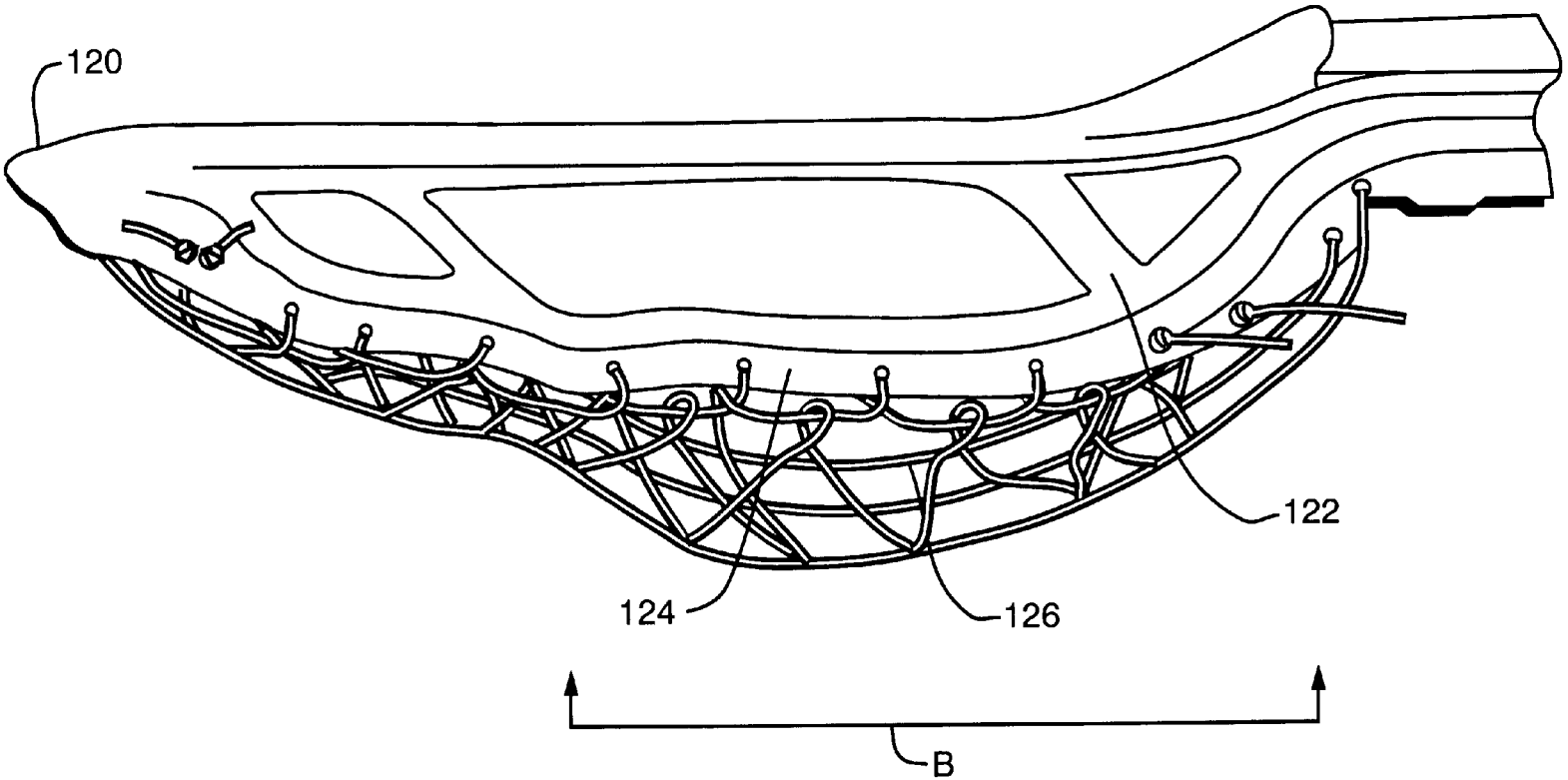
FIG. 6 (PRIOR ART)
FIG. 6 is a side view of the prior art of a lacrosse head strung in a manner appropriate for men's lacrosse.

Pocket lace 92 can be strung in a single piece or separately, in the same manner as pocket 34 of the first described embodiment. Pocket 94 can also be adjusted to the desired depth. FIG. 5 illustrates pocket 94 as hanging between the sidewalls within lacrosse head 60 having a length approximately defined by Arrow A. When adjusted to the same depth as would be typical of prior art lacrosse heads, pocket 94 barely clears bottom edge 98 of sidewall 64. In contrast, FIG. 6 illustrates a typical prior art lacrosse head with the net attached to lacrosse head 120 through netting holes provided proximate the lower edge of sidewall 122, wherein pocket 126 has a length approximately defined by Arrow B. Pocket 126 of prior art lacrosse head 120, not only clears bottom edge 124 of sidewall 126, but falls, in its entirety, below bottom edge 124 of sidewall 122. As shown in FIG. 5, pocket 94 comprises an upper section having an inner area provided between sidewall 64 and its opposing sidewall (not shown) within the frame lacrosse head 60 and a lower section having an inner area that clears bottom edge 98 of sidewall 64. As illustrated in FIG. 5, the area of the upper section of pocket 94 located between sidewall 64 and its opposing sidewall (not shown) is much larger than the area of lower section that clears bottom edge 94.

Figure 8:
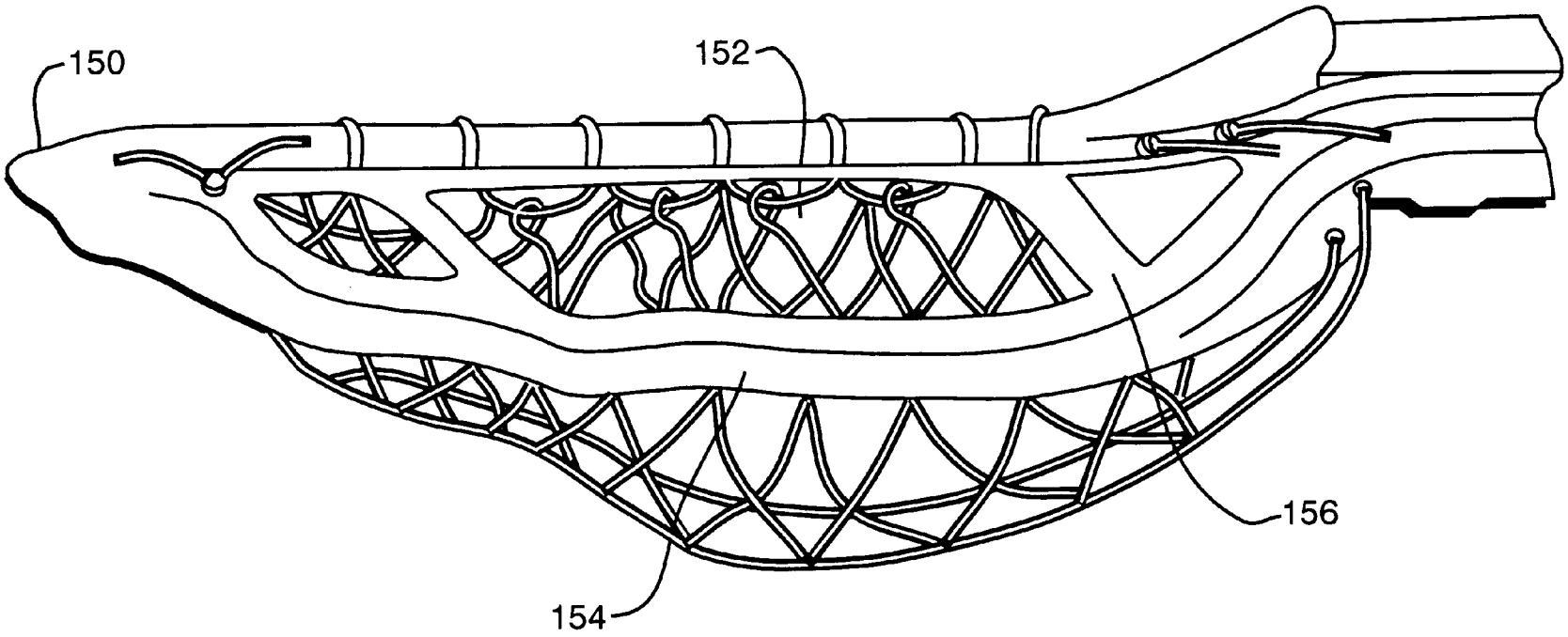
FIG. 8 is a side view of the left side of the frame of yet another preferred embodiment of the invention strung in a manner appropriate for men's lacrosse.

As described above, the depth of the pocket can be adjusted as desired. For example FIG. 5 shows pocket 94 having a depth slightly deeper than the height of sidewall 64 so that pocket 94 barely clears the bottom edge of sidewall 64. Alternatively, FIG. 8 illustrates another preferred embodiment. In FIG. 8 lacrosse head 150 is provided with pocket 152 adjusted to a depth about twice as deep as pocket 94, shown in FIG. 5, so that the lower portion of pocket 152 hangs well below bottom edge 154 of sidewall 156.

The netting holes of all embodiments of this invention should be provided along the sidewall closer to upper edge of the sidewall than the lower edge of the sidewall. The closer the holes are to the upper edge, the deeper the pocket can potentially be. However, each sidewall of this invention generally has a top edge and a bottom edge which may not parallel each other and which do not necessarily follow a straight line. Therefore there is no single point of reference which would aptly apply to all embodiments of this invention. With this in mind, the following description is intended to illustrate the phrase "closer to the upper edge of the sidewall than the lower edge of the sidewall" for purposes of enablement.

Figure 7:
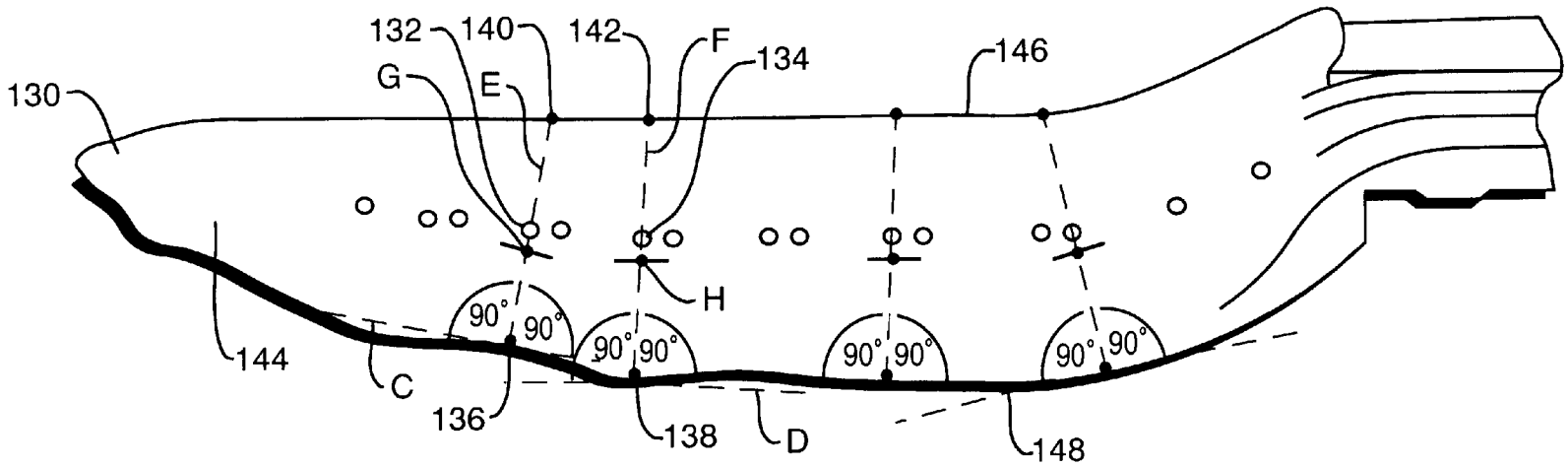
FIG. 7 is a side view of the left side of the frame of yet another preferred embodiment of the invention.

FIG. 7 is a lateral view of another preferred embodiment of the lacrosse head frame of the invention. FIG. 7 shows lacrosse head frame 130 and sidewall 144 having netting holes provided along sidewall 144. Sidewall 144 has a bottom edge 148 and a top edge 146 and an infinite number of bottom points along bottom edge 148, an infinite number of corresponding top points along top edge 146, and an infinite number of corresponding upper areas. The center point of each netting hole should be located in an upper area which corresponds to a specific chosen bottom point and a corresponding top point. These bottom points, corresponding top points and corresponding upper areas are defined as follows.

Any one of an infinite number of points along bottom edge 148 can be chosen to define a particular tangent line, perpendicular line, top point, median point and an infinite number of upper areas, all of which will correspond to that chosen bottom point. For example, bottom points 136 and 138 have been chosen as shown in FIG. 7 for illustration. As shown in FIG. 7, tangent lines C and D have been drawn at bottom points 136 and 138, respectively. Tangent lines C and D are the tangents to bottom edge 148 at bottom points 136 and 138, respectively. Further, corresponding lines E and F, which are perpendicular to tangent lines C and D, respectively, have been drawn from tangent lines C and D to top edge 146. Corresponding top points 140 and 142 represent the points at which perpendicular lines E and F intersect top edge 146, respectively. Point G represents the median point between top point 140 and bottom point 136 along perpendicular line E. Point H represents the median point between top point 142 and bottom point 138 along perpendicular line F. The upper areas directly above, and which correspond to, bottom point 138, are located between median point H and top point 142. Bottom point 138 therefore has an infinite number of upper areas directly between its corresponding median point H and its corresponding top point 142. Likewise, median point G and top point 140 define those upper areas directly above, and corresponding to, bottom point 136. Therefore, bottom point 136 also has an infinite number of upper areas directly between its corresponding median point G and its corresponding top point 140. In essence, the center point of netting hole 132 itself comprises a plurality of these infinite number of upper areas which correspond to bottom point 136. As such, netting hole 132 is within the scope of this invention because its center point is located at an upper area which is above median point G and therefore is closer to corresponding top point 140 than to bottom point 136.

Figure 9:
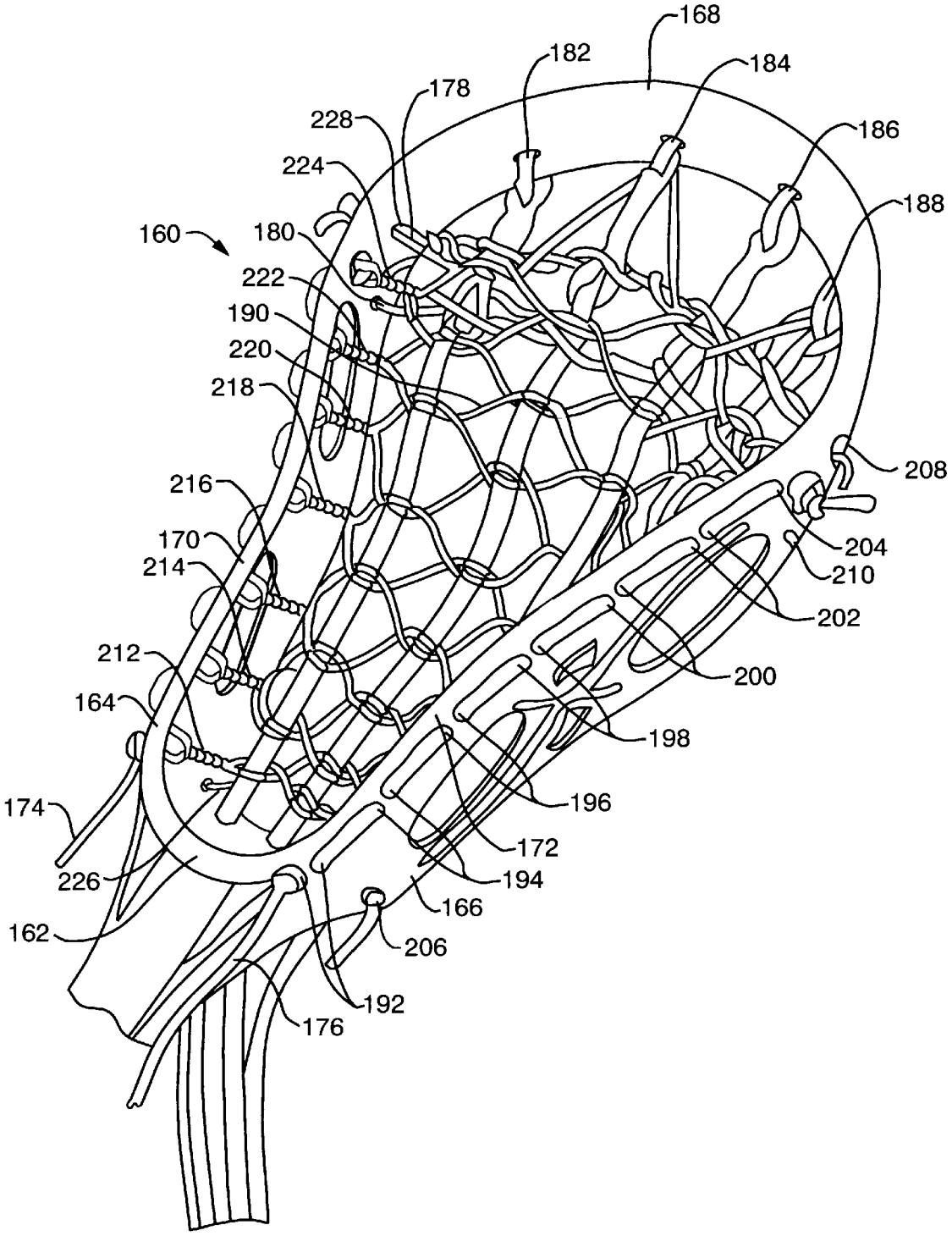
FIG. 9 is a perspective view of yet another preferred embodiment of the invention.

FIG. 9 illustrates a preferred embodiment of the invention as lacrosse head 160. The frame of lacrosse head 160 is made up of a throat portion 162, sidewalls 164 and 166 which diverge from throat portion 162, a lip portion 168 which joins sidewalls 164 and 166 opposite from throat portion 162. Sidewalls 164 and 166 have upper edges 170 and 172, respectively. Sidewall laces 174 and 176, shooting strings 178 and 180, leather thongs 182–188, and pocket lacing 190 are shown fully strung using another preferred embodiment of the method of the invention for stringing. Also shown are hole pairs 192, 194, 196, 198, 200, 202 and 204; pocket stringing tie-off hole 206; and shooting string holes 208 and 210. Depending upon the design of the molded head employed as a frame for this invention, the sidewall string holes may be drilled or molded with their axis perpendicular to the outside surface of the sidewalls, or with an axis parallel to an imaginary plane across the top of both sidewalls, whichever is most easily accomplished in the manufacturing process. Any of the sidewall string holes may be bored or molded directly through the sidewalls.

The preferred method of stringing of this invention is described as follows and may be used with any embodiment of the men's or women's lacrosse stick heads of this invention. As shown in FIG. 9, leather thongs 182–188 are strung from holes in lip portion 168 to corresponding holes in throat portion 162. The sidewall lace 176 is initially tied off at the first hole of hole pair 192 and threaded from the outer side of the sidewall through string hole pairs 192 through 204 and finally tied off at the second hole of hole pair 204. In like manner, sidewall lace 174 is threaded through corresponding holes provided in sidewall 164. Shooting strings 178 and 190 are threaded behind and in between leather thongs 182–188 and tied off along the sidewall at shooting holes 208 and hole 210, respectively.

Pocket lacing 190 can be strung separately, preferably in three pieces as follows. Start the first piece of pocket lacing by threading the lacing through shooting string hole 228 and tying a knot in the line, then loop down between leather thong 182 and sidewall lace 174. The juncture of pocket lacing 190 and sidewall lacing 174 is accomplished by multiple twists. For example, twists 212 through 224 are shown threaded through string holes (not shown but corresponding to string hole pairs 192 through 204 shown in sidewall 166) provided in sidewall 164. These twists perform two important functions: first, they provide additional "give" or spring to the pocket, and second, they lower the pocket stringing down from the top of the sidewall to permit a deeper pocket while remaining within legal limits. For example, working down from twist 224 (three rotations per twist) to twist 222 (four rotations per twist) to twists 220, 218, 214 and 212 (five rotations per twist), pocket lacing 190 is finally tied off by passing through stringing tie off hole 226 and knotting on the outside of the sidewall 164. The second part of the pocket lacing is woven into the head in exactly the same manner as the first, beginning with shooting string hole 208, and working down between leather thong 188 and sidewall lace 176 and forming similar twists proximate sidewall 166. This second part of pocket lacing is tied off at stringing tie off hole 206 on the outside of sidewall 166.

Start the third piece of pocket lacing by knotting the lacing through the top of thong 182 and work down and up between thongs 182–188. Reverse the course of the pocket lacing between thongs 182 and 184 by passing the lacing through a slit cut near throat portion 162 on thong 184, work up towards lip portion 168 between thongs 184 and 186, and finally down between thongs 186 and 188. Tie off this third piece of pocket lacing with a hitch knot at a slit cut in thong 186 near throat portion 162. This completes stringing assembly of the stick head.

Before play, thongs 182–188 may be adjusted to provide desired pocket depth, and then tied off with a half hitch at the throat portion 162. Pocket lace 190 can also be adjusted for depth and location by re-tensioning the leather thongs 182–188 and/or by adjusting sidewall laces 174 or 176. Adjustment of sidewall laces is effected by first loosening the knot at the first hole of string hole pair 192 and then pulling the slack material through successive string hole pairs 192–204. Leaving a bigger loop inside sidewall 166 produces a deeper pocket in that specific area of the netting. Identical adjustments may be made with the sidewall lace 174.

The twists are not limited to three, four and five rotations each. The overall length of each twist and the number of rotations will depend on the desired depth of and give to the net.

Preferred materials of lacing construction for all preferred embodiments of this invention are commercially available, chiefly through firms specializing in nautical cordage. The sidewall laces are preferably a 3/32" (2 mm) or 1/8" (3 mm) braided polyester cover over braided Technora (aramid) core. The pocket lacing is preferably a 2 mm braided polyester cover over polyester core or, alternatively, a 1.5 mm polyester cover over braided Spectra (also known as Dynema) core. Although braided nylon 2–4 mm diameter, sheathed and unsheathed, may be used for the sidewall lacing and pocket lacing, these materials are not as durable.

Figure 10:
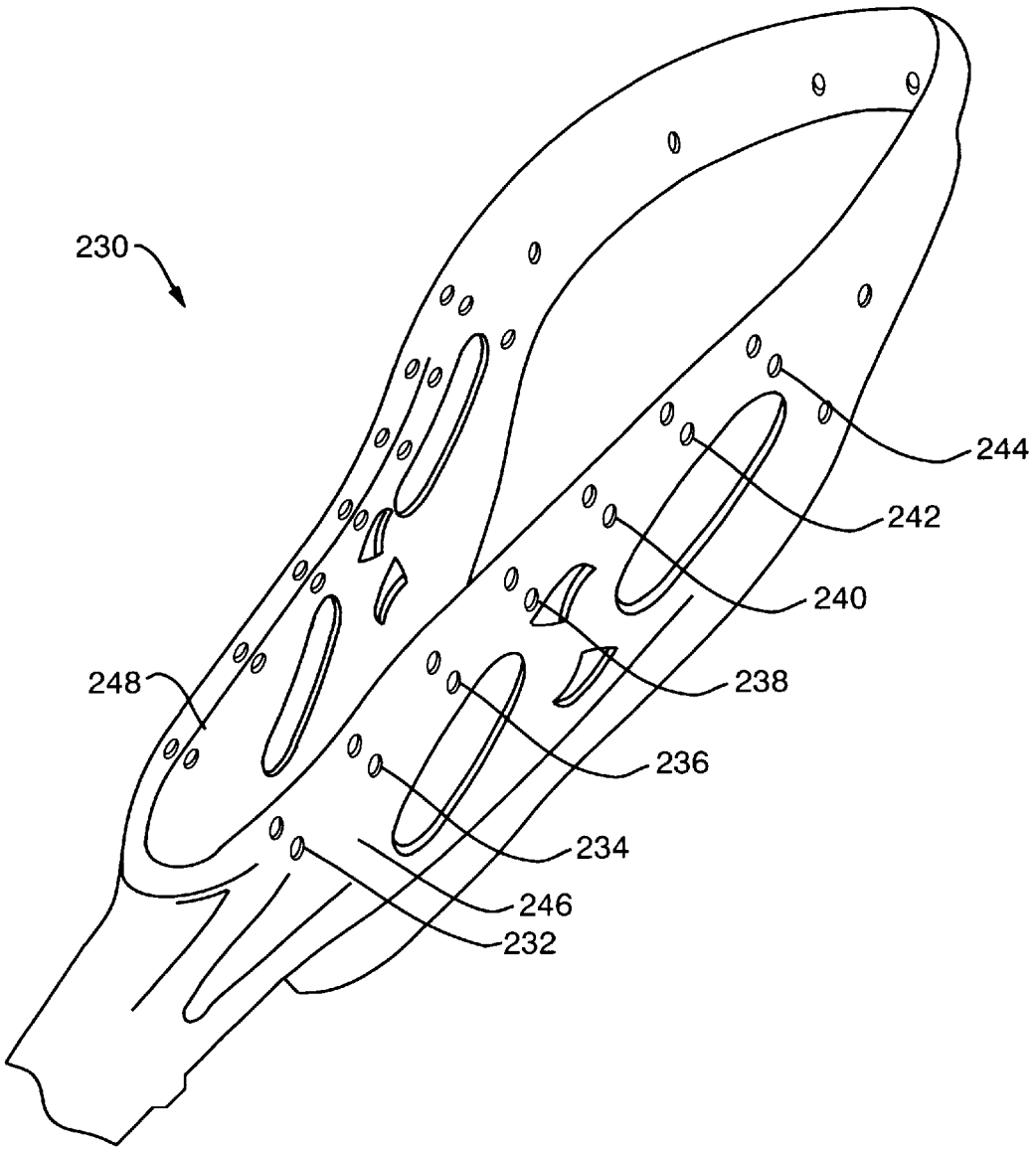
FIG. 10 is a perspective view of yet another preferred embodiment of the invention without any lacing materials.

Another embodiment of the invention applied to a women's lacrosse head is shown in FIG. 10 as lacrosse head 230. In this embodiment the string hole pairs 232–244 are positioned perpendicular to the top of sidewall 246. Corresponding string hole pairs are similarly provided in sidewall 248. The net shown in FIG. 10 is strung in a manner similar to that described above with respect to lacrosse head 160.

Figure 11:
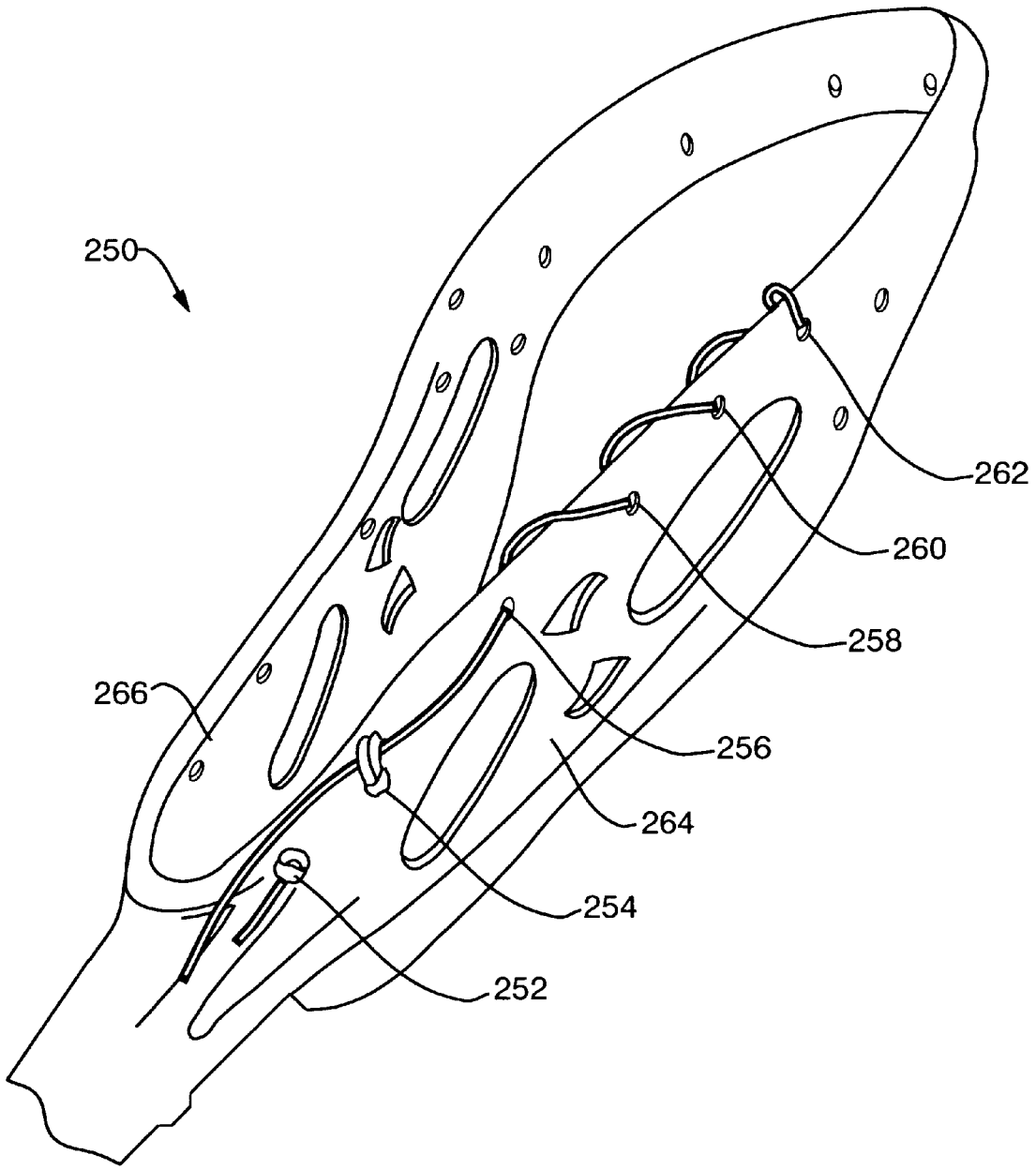
FIG. 11 is a perspective view of yet another preferred embodiment of the invention without any lacing materials.

FIG. 11 illustrates another preferred embodiment of the lacrosse head of the invention applied to women's lacrosse head as lacrosse head 250. In lacrosse head 250 the sidewall laces are threaded through single holes provided in sidewalls 264 and 266. For example, sidewall string holes 252–262 are bored through sidewall 264 proximate the upper edge of sidewall 264. In this embodiment the sidewall lacing would be run, for example, straight up from sidewall hole 252 to sidewall hole 262, then back through holes 260–254 to hold it in place along sidewall 264. The sidewall lacing would then be tied off upon itself with a hitch knot proximate hole 254.

Figure 12:
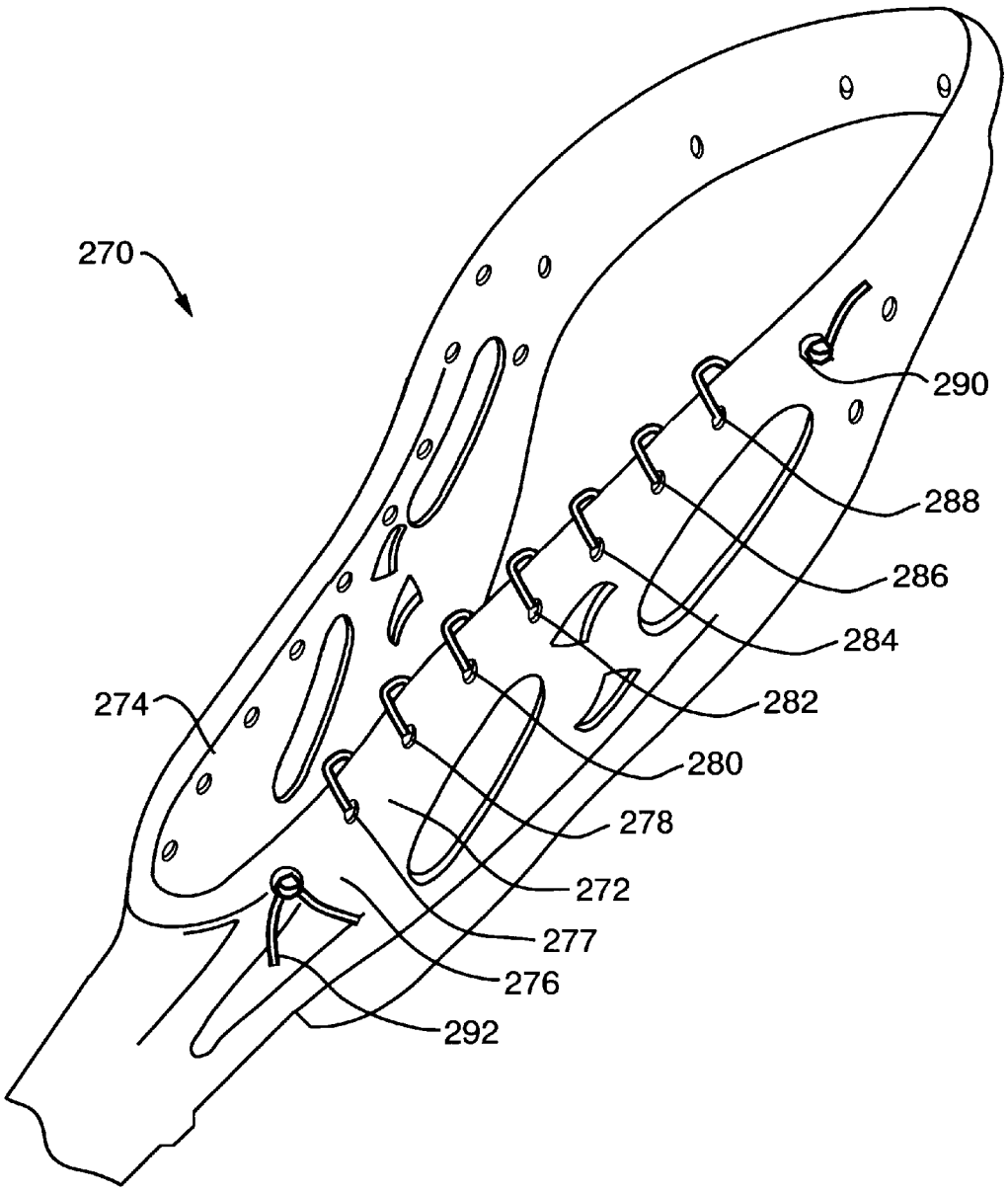
FIG. 12 is a perspective view of yet another preferred embodiment of the invention shown only partly strung.

FIG. 12 illustrates yet another preferred embodiment of the invention applied to a women's lacrosse head as lacrosse head 270. In this embodiment, for example, sidewall lace 292 is threaded through single string holes 292 through 290 provided proximate the upper edge of sidewall 272 and secured in place by a series of half-hitches from outside to inside of sidewall 272.

In general, the closer the means for attaching the netting to the frame is to the top edge, the deeper the pocket can potentially be. The means for attaching the net can take the form of the holes as described in the preferred embodiment of any size or shape, or may comprise tabs, notches, v-grooves, lace locks or any other mechanical means suited to fastening a net, rope or string to an object in a manner to endure substantial tension.

Although specific features of the lacrosse head of the invention and the method of the invention are shown in some drawings and not others, this is for convenience only as some feature may be combined with any or all of the other features in accordance with the invention.

Other embodiments will occur to those skilled in the art and are within the following claims:

What is claimed is:

1. A lacrosse stick head comprising, a net and a frame wherein said frame comprises, a throat portion;

two sidewalls, diverging from said throat portion, each sidewall having a bottom edge and a top edge, and a plurality of bottom points and a plurality of corresponding top points, wherein any one of said bottom points is chosen along said bottom edge and at which there is a tangent line, wherein a said corresponding top point is the point at which a line perpendicular to said tangent of a said chosen bottom point intersects said top edge, wherein said sidewalls have a plurality of upper areas corresponding to one or more corresponding top points which correspond to one or more chosen bottom points, and wherein each of said upper areas is closer to its said corresponding top point than to its said chosen bottom point;

a means for securing said net to said sidewalls at one or more of said upper areas so that at least a portion of said net, when secured, hangs between said sidewalls; and a lip portion joining said sidewalls opposite said throat portion.

2. The lacrosse stick head of claim 1, wherein said means for securing said net comprises a plurality of holes provided through said sidewalls proximate said upper edge of said sidewalls.

3. The lacrosse stick head of claim 1, wherein said sidewalls further comprises one or more flanges, and wherein said means for securing said net comprises a plurality of holes proximate one or more of said flanges.

4. The lacrosse stick head of claim 1, wherein said net comprises one or more twists which extend downward from said top edge of one or both of said sidewalls.

5. The lacrosse stick head of claim 4, wherein said twists comprise a series of graduated twists.

6. A lacrosse stick head comprising a frame and net, wherein said frame comprises, a throat portion;

two sidewalls diverging from said throat portion and having a lower edge; and a lip portion;

wherein said net comprises, a pocket having a depth, wherein a greater portion of said depth of said pocket is provided between said sidewalls within said frame than below said lower edge; and a shooting section.

7. The lacrosse stick head of claim 6, wherein said sidewalls further comprise, a bottom edge and a top edge, and a plurality of bottom points and a plurality of corresponding top points, wherein any one of said bottom points is chosen along said bottom edge and at which there is a tangent line, wherein a said corresponding top point is the point at which a line perpendicular to said tangent of a said chosen bottom point intersects said top edge, wherein said sidewalls have a plurality of upper areas corresponding to one or more corresponding top points which correspond to one or more chosen bottom points, and wherein each of said upper areas is closer to its said corresponding top point than to its said chosen bottom point; and further comprising a means for securing said net to said sidewalls at one or more of said upper areas so that at least a portion of said net, when secured, hangs between said sidewalls.

8. The lacrosse stick head of claim 7, wherein said means for securing said net comprises a plurality of holes provided through said sidewalls proximate said upper edge of said sidewalls.

9. The lacrosse stick head of claim 7, wherein said sidewalls further comprise a flange, and wherein said means for securing said net comprises a plurality of holes proximate said flange.

10. The lacrosse head of claim 7, wherein said net comprises one or more twists which extend downward from said top edge of one or both of said sidewalls.

11. The lacrosse stick head of claim 10, wherein said twists comprise a series of graduated twists.

* * * * *